United States Patent [19]

Delatte et al.

[11] 4,235,278

[45] Nov. 25, 1980

[54] RING FOR A CASTING MACHINE WHEEL

[75] Inventors: Marc Delatte, St. Cloud; Philippe Chevalier, Champigny-sur-Marne, both of France

[73] Assignee: Aluminum Pechiney, Lyons, France

[21] Appl. No.: 965,926

[22] Filed: Dec. 4, 1978

[30] Foreign Application Priority Data

Dec. 22, 1977 [FR] France ..... 77 39910

[51] Int. Cl.[3] ..... B22D 11/06

[52] U.S. Cl. ..... 164/433; 164/87

[58] Field of Search ..... 164/87, 427, 432, 433, 164/434

[56] References Cited

U.S. PATENT DOCUMENTS

| | | | |
|---|---|---|---|
| 3,311,955 | 4/1967 | Richards | 164/433 |
| 3,319,700 | 5/1967 | Bray et al. | 164/433 |
| 3,329,197 | 7/1967 | Cofer | 164/87 |
| 4,033,405 | 7/1977 | Properzi | 164/87 X |

FOREIGN PATENT DOCUMENTS

| | | | |
|---|---|---|---|
| 1215853 | 12/1970 | United Kingdom | 164/433 |

*Primary Examiner*—R. L. Spruill
*Assistant Examiner*—K. Y. Lin
*Attorney, Agent, or Firm*—McDougall, Hersh & Scott

[57] ABSTRACT

The invention concerns an improvement in the casting ring which is provided on the periphery of the wheel in continuous casting machines. This ring is characterized in that its entire internal surface is in contact with the cast metal in the region of solidification, it is mounted completely freely on its support means, and it has a thickness in the vicinity of 1 mm. These characteristics enable it to be deformed when hot into a shape which is similar to its cold profile. This gives rise to the possibility of controlling the solidification of ingots and the aptitude for withdrawing the ingots without surface defects at a temperature higher than that obtained by the customary machines.

8 Claims, 2 Drawing Figures

RING FOR A CASTING MACHINE WHEEL

This invention relates to casting rings provided on the periphery of the wheel in continuous casting machines. It is used in particular in the casting of ingots of non-ferrous metals, such as aluminum and its alloys, which are rolled and hardened directly in a continuous process in order to obtain machine wire.

Machines for continuous casting on a wheel are known to the skilled in the art. The kinds used most frequently, at present, are illustrated diagrammatically in FIG. 1 which shows a casting wheel 1 provided with a rim 2 which is partially closed on its periphery by an endless band 3 so as to form a cavity serving as a mold 4. This mold is cooled externally by a liquid, the distribution of which is ensured simultaneously from the exterior of the machine towards the band by a circuit 5 and from the interior of the wheel towards the rim by a circuit 6.

In operation, the casting wheel rotates in a clockwise direction and entrains the endless band which is applied against the rim with the aid of a pulley 7. The liquid metal coming from a feed system 8 is introduced at a point 9 where the band comes into contact with the rim; it engages in the mold and cools at the cold walls to emerge in the form of an ingot 10 at a point 11 where the band comes off the wheel. This ingot can then be rolled in a continuous process in a rolling mill 12 and then cooled in a continuous process at 13 in order to conclude the operation of hardening the machine wire 14 which is wound onto a bobbin 15 before being subjected to subsequent transformation operations.

Numerous modifications have been made to this type of machine in order to increase its performance and to resolve problems presented during its operation. In particular, attempts have been made to improve the conditions for cooling the cast metal by acting upon the heat exchange, either between the mold and the cooling circuits or between the mold and the cast metal. This has led to a whole series of embodiments differing from one another by their nature and the shape of the rim, the cooling system or their mutual cooperation.

Thus it is that, in the present state of the art, rims of copper alloy are used most frequently since these materials have good thermal conductivity. However, for reasons of mechanical properties, these rims must have a wall thickness in the region of approximately 10 mm and in view of this fact they are rigid and ill-equipped to withstand the great thermal stresses to which they are subjected cyclically when they come into contact with the liquid metal.

In addition, in order to lessen these stresses and to attempt to obtain a service life acceptable for industrial use, it is necessary considerably to cool the rim, which causes the ingot to leave the mold at a relatively low temperature. Furthermore, since cooling takes place in contact with the mold, the liquid metal is initially surrounded with a solid crust which, by reason of the different specific volumes in these two states, is accompanied by contraction and by the ingot subsequently withdrawing from the wall of the mold, thus diminishing the heat exchange between the rim and the metal. Since the core of the ingot has remained very hot, this heat diffuses towards the crust and causes it to expand and the ingot once more comes into contact with the rim, exchanges heat with the surface of the rim and shrinks; a cyclical process is thus established during solidification, the course of which cannot be ascertained. A totally random and consequently uncontrollable cooling thus results. Furthermore, when the ingot comes away from the mold, blisters are formed on its surface due to the diffusion of heat towards the crust to define areas in which the additives separate from one another if the cast product is an alloy.

In short, the copper-base rim of the prior art presents three fundamental defects, which are uncontrollable cooling of the ingot, a relatively low temperature and the presence of surface blisters.

The fact that it is impossible to control cooling and that there is a relatively low temperature, necessitates subsequent heating and regulating devices when it is desirable to submit the ingot to either dimensional or thermal treatments in a continuous process. In fact, an inadequate temperature necessitates the use of greater forces during rolling and the more so as the hot mechanical characteristics of the rolled metal are raised. An inadequate temperature does not permit suitable hardening in the case of age-hardening alloys because the additives are not completely dissolved. The use of these devices involves costly investments, high energy consumption and medium efficiency with regard to temperature control.

Furthermore, the presence of blisters on the ingots gives rise to surface defects on the rolled wire which are troublesome as regards drawn wires of present day diameters and a latent defect in wires which are intended for drawing fine wires so that their diameters are less than 1 mm. One is, therefore, obliged to work the ingot before or during the course of rolling in order to render it suitable for drawing. This operation also increases the manufacturing cost of the finished product.

Finally, all these drawbacks result from the use of a rim with a thick, rigid wall. For this reason, research has been undertaken with a view toward replacing this rim with a ring having a deformable wall. However, none of the systems proposed to date have been able to be used industrially without presenting the defects listed above, while failing to provide a solution to the problems of thermal and mechanical stress.

This is why the applicant, seeking to overcome these drawbacks presented by the known machines, has sought and perfected a ring which is subjected to the minimum mechanical and thermal stresses and is so designed that the mold formed by the ring is deformed when hot into a shape similar to its cold profile. It is an object of this invention to provide a ring characterized in that, while maintaining contact between the ingot and the band, the entire internal surface in the region of thermal exchange with the metal is in contact with the cast ingot throughout the cooling period, and it is mounted completely freely on its support means and that it is thin.

These and other objects and advantages of this invention will hereinafter appear, and for purposes of illustration, but not of limitation, an embodiment of the invention is shown in the accompanying drawing, in which.

Figure 1:
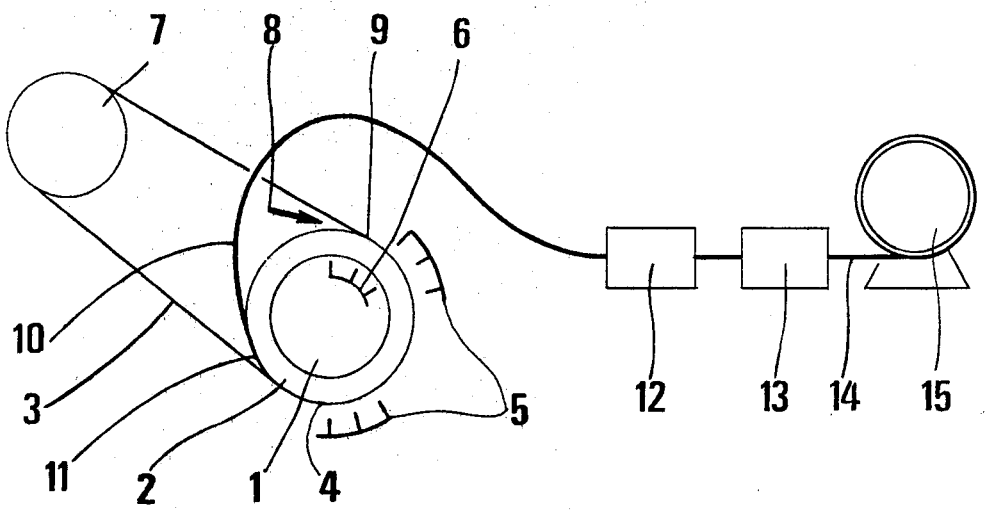
FIG. 1 is a diagrammatic view of a casting wheel old in the art.
Figure 2:
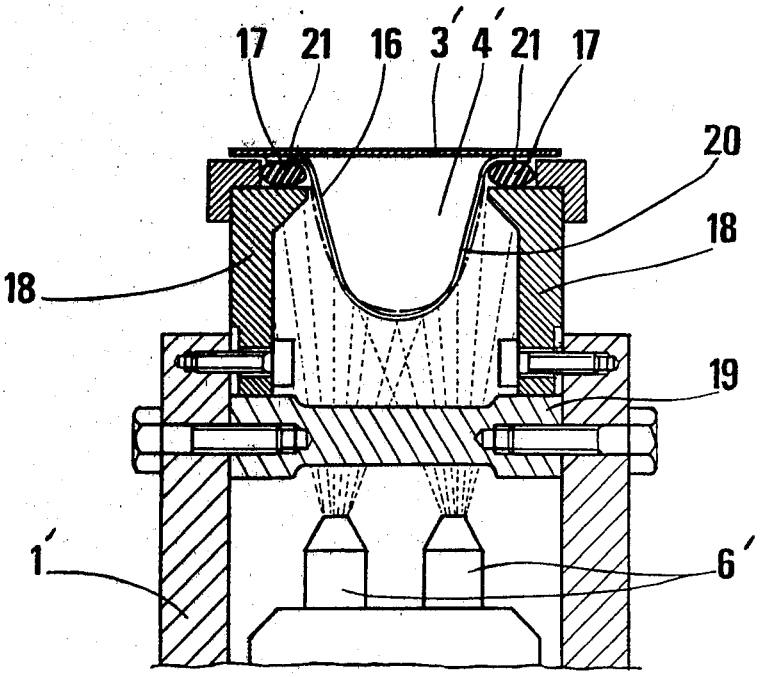
FIG. 2 is a sectional view of a portion of a casting wheel embodying the features of this invention.

The invention will be better understood with reference to FIG. 2. Therein, the ring 16 replaces the rim 2 of the prior art and forms together with the band 3' a mold 4'. This ring rests on two circular joints 17 situated on the peripheral wall of two flanges 18, which are rigidly connected with one another by tie rods 19 fixed with respect to the wheel 1. The entire surface of this ring is cooled by means of a circuit 6 which enables the heat exchange liquid either to be circulated or atomized, this circuit being sealed in relation to the exterior of the machine by means of the joints 17.

By virtue of its compact shape comprising one portion 20 in contact with the ingot and two very narrow edges 21, by means of which it rests on the joints 17, this ring, when situated in the region of thermal exchange with the metal, is in contact over its entire internal surface, i.e. internal to the mold, with the cast ingot. Due to this fact, the temperature gradient in each section of the ring is very low, thus providing limitation on the maximum thermal stresses.

By virtue of its mounting, the ring remains completely free; the only points of contact with the wheel are the joints which, being composed of flexible material, do not exert any substantial mechanical stress. Also, the ring is free to act in its own way according to the thermal stresses of expansion or contraction.

By reason of the low level of stresses to which it is subjected, this ring is endowed by its shape and mounting with the ability to deform itself in a similar manner; when it is heated by the liquid metal, the bottom lowers and the sides move apart, thus permitting contact between the ingot and the ring to be maintained over the entire periphery of the profile of the mold when the assembly contracts. As a result, it is impossible for separation to occur and consequently to impair the thermal exchanges. Due to this fact, cooling ceases to be a random process and can be perfectly controlled. Furthermore, the phenomena of alternate cooling and heating of the crust, as in the systems of the prior art, can no longer occur, thus eliminating the formation of blisters.

One might also add that, by reducing the thermal and mechanical stresses to a minimum, the service life of the ring is, as a result, greatly increased.

Another characteristic of this ring is its thinness, which limits the thermal gradient through its mass and thus permits higher casting temperatures. A thickness of less than 2 mm is preferred.

Among the materials used in the construction of the ring all the metals having good hot characteristics, i.e. a high level of resilience, high thermal conductivity, a high coefficient of expansion, are suitable, thus use can be made of beryllium bronzes and nickel alloys, but preference is given to the mild steel alloys containing elements, such as vanadium and chromium, such as a mild chromium-vanadium steel alloy and a steel complying, for example, with the type 15 CDV6.

A casting machine constructed according to the invention enables several dozen tons of ingot of an aluminum-magnesium-silicon alloy to be continuously cast; the ingot has been rolled into a wire having a diameter of 9.5 mm, continuously hardened and drawn. By adjusting the cooling of the ring and at a given speed, it is possible to vary the temperature of the ingot at the point of emergence from the mold between 480° and 560° C. The surface of the solidified metal has no blisters, of the type obtained with rings or rims of the prior art.

Thus, this ring, permits precise control of the cooling and solidification of the cast metal and the possibility of removing the ingots at higher temperatures without causing surface defects. The following advantages are derived from these results:

increase in machine capacity rolling of more alloyed alloys on a rolling mill of given power improvement in the surface quality of the products obtained and, furthermore, the possibility of achieving thinner sections during the course of drawing with less risk of breakage the possible insertion downstream of the machine of devices for continuous rolling and hardening without the need for heating furnaces, thereby to economize on material, energy and time.

This ring is used in particular in:

the casting of ingots of aluminum or aluminum alloys which have to be rolled and hardened in a continuous process.

the production of machine wire to be drawn into thin wire (telephone, windings).

It will be understood that changes may be made in the details of construction and operation, without departing from the spirit of the invention, especially as defined in the following claims.

We claim:

1. In a continuous casting machine of the wheel and band type, the improvement wherein said wheel includes a pair of axially spaced apart circular flanges, a deformable thin metal ring the lateral edges of which overlap at least a portion of the flanges with the portion of the metal ring in between the lateral edges defining a mold groove located between said flanges, a circular joint of flexible material disposed on each of the portions of the flanges overlapped by said lateral edges whereby a circular joint is disposed between each flange portion and overlapping edge to effect a joinder therebetween, the band of the casting machine engaging said overlapping edges, and said joinder being effected in response to pressure applied by the circular joints to define said mold groove between the band and the portion of the ring between the flanges, while enabling relative movement between the overlapping portions of the ring and the flanges.

2. In a continuous casting machine of the wheel and band type, the improvement comprising a metal ring mold for use in said machine, said ring mold having laterally extending edge portions with the portions in between defining a mold groove, said ring mold having a thickness of less than 2 mm, the internal surface of said ring mold remaining in contact with the metal cast into the mold groove during expansions and contractions of the cast metal during conversion from the molten state to the solid state to provide for optimum heat transfer between the ring mold and the cast metal throughout the cooling period.

3. A wheel as claimed in claim 1 in which the ring has a thickness of less than 2 mm.

4. A wheel as claimed in claim 1 in which the ring is made of steel.

5. A wheel as claimed in claim 3 in which the ring is made of a mild chromium-vanadium steel alloy.

6. A wheel as claimed in claim 1 in which the ring is made of a beryllium bronze.

7. A wheel as claimed in claim 1 in which the ring is made of a nickel alloy.

8. A metal ring as claimed in claim 2 in which the metal of which the ring is formed is selected from the group consisting of steel, a mild chromium-vanadium alloy, a beryllium bronze, and a nickel alloy.

* * * * *